United States Patent [19]

Hickey

[11] 4,395,952

[45] Aug. 2, 1983

[54] UNDERWATER WEAPON SYSTEMS

[76] Inventor: Christopher D. D. Hickey, 5 Heathside, Hinchley Wood, Esher, Surrey, England

[21] Appl. No.: 213,071

[22] Filed: Dec. 4, 1980

[51] Int. Cl.[3] ..... F42B 22/00; F41F 3/08; F41F 3/10

[52] U.S. Cl. ..... 102/411; 89/1.81

[58] Field of Search ..... 102/411, 406; 89/1.81, 89/1.809

[56] References Cited

U.S. PATENT DOCUMENTS 3,038,406 6/1962 Elmer ..... 102/412

FOREIGN PATENT DOCUMENTS 2032126 1/1972 Fed. Rep. of Germany .
1545658 10/1968 France .
216905 6/1924 United Kingdom .

*Primary Examiner*—Charles T. Jordan
*Attorney, Agent, or Firm*—Young & Thompson

[57] ABSTRACT

An underwater weapon system comprises a container for a self-propelled weapon with target homing means, the container including pumps having inlets on the underside of the container to pump silt, gravel etc, from underneath the container whereby the container can be buried or partially buried in the sea bed. Reverse operation of the pumps raises the container which is opened automatically, e.g. with a radio control system, to release the weapon when the weapon is to be used.

11 Claims, 2 Drawing Figures

UNDERWATER WEAPON SYSTEMS

BACKGROUND OF THE INVENTION

1. Field of the Invention

This invention relates to underwater weapon systems.

2. Prior Art

It is well known for self-propelled underwater weapons, such as torpedoes, to be carried on surface craft, submarines and aircraft. It is also well known to use static self-contained underwater weapons such as mines.

BRIEF SUMMARY OF THE INVENTION

According to one aspect of the present invention, there is provided an underwater weapon system comprising a self-propelled weapon with target homing means, a watertight container for the weapon, pump means having an inlet or inlets on the underside of the container and an outlet or outlets above the underside, whereby sand or slit under the container may be pumped away to cause the container to become buried in sand or silt on the sea-bed, the pump means being operatively reversible to pump sand or silt underneath the container for raising the container.

The use of moored mines is well-known. The laying of a minefield, for example to safeguard an area such as the approaches to a harbour, is an expensive operation. Particularly in wartime, the positioning of such mines may be haphazard.

According to another aspect of the present invention, there is provided an underwater weapon system comprising a self-propelled weapon with target homing means, and a container for said weapon, said container including pump means having an inlet or inlets on the underside of the container and an outlet or outlets above the underside, said container further having control means for operating said pump means and further control means operative to open the container to permit release of the weapon.

The weapon may typically be a torpedo and may be of conventional construction, for example with an acoustic sensor or other target-detecting device controlling guidance means for guiding the torpedo towards a target. Other forms of self-propelled weapons suitable for underwater release may be employed.

With the weapon system of the present invention, the container, with the weapon in it, is put on the sea-bed and the pump means are operated to pump silt or sand, which covers the majority of the sea bed, particularly in shallow water, from underneath the container and to eject it above the base of the container. Thus the container will bury itself in the sea-bed. Means may be provided to stop the pump means when the container is buried to a predetermined depth.

Most self-propelled underwater weapons are of generally elongate form. The container, in such a case, is also preferably of elongate form. It may be buried with its axis vertical or in a generally horizontal position. It is is buried in a vertical position, the upper end may be left protruding above the sea bed. More generally however the container may be completely buried and, when the weapon is to be activated, the container has to be raised by reverse operation of the pump means.

Activation of the weapon system may be effected by an external command signal, for example transmitted by acoustic or electromagnetic signalling to a receiver within the container or it may be effected in response to an output of a target detection sensor within the container. The activation may be in one or more stages, for example the container may be raised to the surface of the sea bed initially and further operation may then be deferred until a sensor detects a target whereupon the container is opened for launching of the weapon.

If this weapon system is used defensively, for example for defence against surface vessels or underwater vessels approaching a harbour, control means, operating by electromagnetic or acoustic radiation or by a communication cable may be provided for activating and deactivating the system as required. Particularly if a power supply can be fed to the system, it is readily possible then to bury and raise the container as often as required.

If the weapon system is to be used offensively, for example in the sea near enemy territory, the ability to have the system buried in the sand or silt in the sea bed significantly reduces the possibility of detection of the weapon.

If acoustic or electromagnetic radiation signals are to be received when the container is buried in the sea bed, receiving means may be provided which can be erected and retracted as required. A programmed intermittent listening with retraction of the receiving sensor, e.g. radio aerial, may be employed to reduce the possibility of detection.

By the use of a self-propelled weapon, this weapon system enables action to be taken, for example against surface or underwater craft, over a large area, far larger than is possible with conventional mines. If a number of weapon systems are deployed, they may be linked, for example to a central listening system so as to ensure that the weapon most advantageously sited is employed.

In the foregoing, the use of a weapon such as a torpedo has been referred to more particularly as a means of attack on surface or underwater craft. The weapon however may be any weapon suitable for underwater launching and may, for example, be a ballistic missile. A ballistic missile may be guided, in a known way, in accordance with pre-programmed or pre-received instructions, onto a selected static target defined by its geographical location, or it may have target-detecting sensor means.

Preferably the container or at least the part thereof housing the weapon is constructed to be watertight and pressure-tight. The weapon thus may be stored in a predetermined atmosphere, for example with controlled humidity, and/or in an inert gaseous atmosphere.

Although, in the above, the container has been described in combination with a self-propelled weapon, this type of container may be used more generally for the storage of weapons or other equipment. For example it might be used for the storage of weapons, supplies or other equipment for use on submarines, particularly nuclear submarines having long-term underwater capability. This would enable such vessels to be re-supplied without having to come to the surface.

DESCRIPTION OF THE PREFERRED EMBODIMENT

Figure 1:
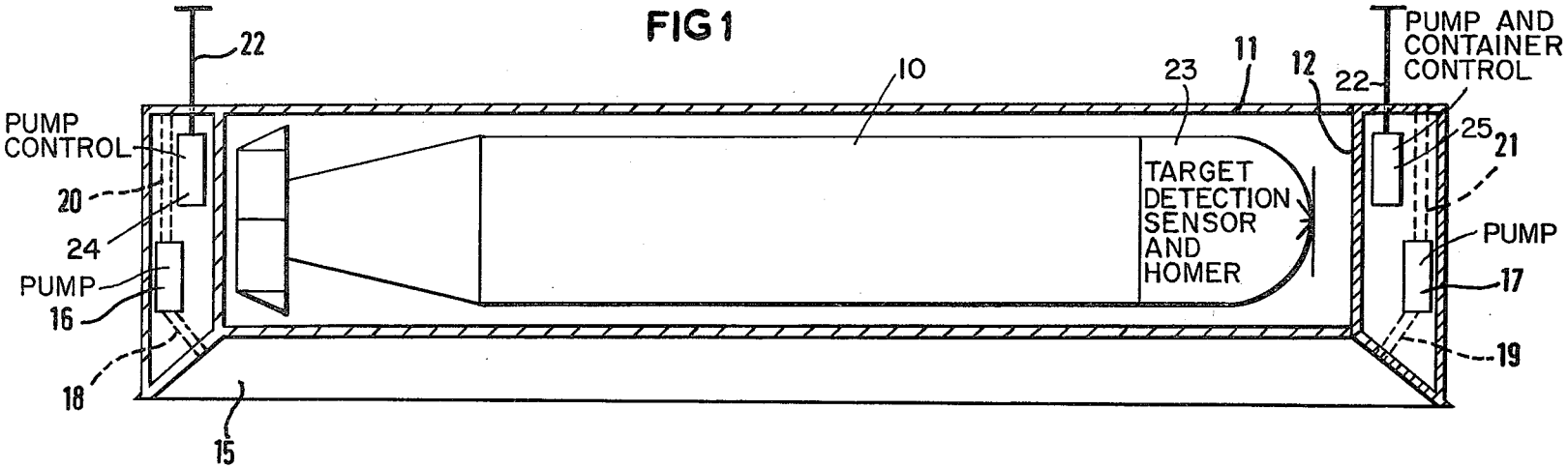
FIG. 1 is a diagrammatic side elevation of a weapon system constituting one embodiment of the present invention.
Figure 2:
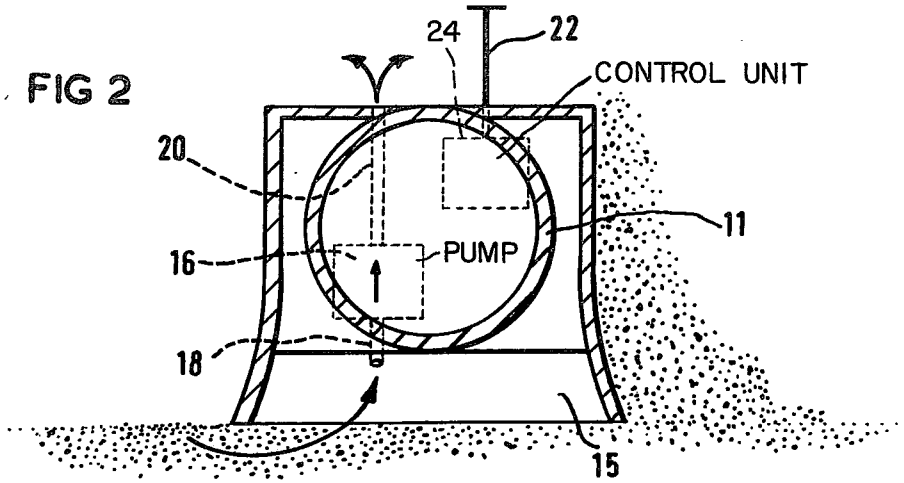
FIG. 2 is an end elevation with the end plate removed.

Referring to FIG. 1 there is shown diagrammatically a self-propelled weapon 10 which, in this case, is a conventional torpedo for underwater travel, the torpedo including a homing means 23 for sensing a target and for control of guidance means. This weapon 10 is housed within a pressure-tight chamber 11 which is closed at the forward end by a detachable bulkhead 12.

This particular weapon system is arranged to sit on the sea bed substantially horizontally and to be buried in the sea bed in a substantially horizontal position. Along the whole length of the bottom of the container is a suction chamber 15. Suction pumps 16, 17 are provided having inlets 18, 19 leading to this suction chamber 15. A plurality of such inlets may be provided if necessary opening into the suction chamber at spaced points along the length thereof. These pumps have outlets 20, 21 respectively on the upper surface of the container.

It will be seen that, if the container is put on its base on the sea bed and the pumps are operated, the sand and/or silt on the sea bed will be sucked upwardly from underneath the weapon system via the suction chamber 15 and the pumps 16, 17 and ejected upwardly through the outlets 20, 21. Such operation of the pumps therefore causes the container to bury itself within the sea-bed. Normally the pumps would be operated until the top of the container is approximately at the level of the sea-bed, in other words, the container is substantially completely buried in the sand or silt. Reversal of the pumps, by pumping sand or slit into the region underneath the container will raise the container. If the foward pump 17 is connected to the forward part of the suction chamber 15, operation of the forward pump only would cause the forward end of the container only to be lifted. This may be preferred in some cases for launching a weapon.

In the particular embodiment illustrated, two retractable aerials 22 are shown for reception of communication signals for activating the system. Such activation can be arranged, via control units 24,25, to operate the pumps 16, 17 to raise the container or at least the forward end thereof. A sensor 23 for detecting the presence of a surface craft or underwater craft is provided in the container. Such a sensor may for example be an acoustic sensor and the container may contain programme means containing the "voice prints" of known targets so that any received signals may be analysed and identified and if necessary compared with such voice prints. The listening watch may be continuous or may be intermittent. When a target vessel is detected, the aforementioned forward bulkhead with the forward pumping compartment is removed by control unit 25 and the weapon is launched. The weapon, as previously mentioned, is self-prepelled and has homing means to guide it towards the target.

I claim:

1. An underwater weapon system comprising a self-propelled weapon with target homing means, a watertight container for the weapon, pump means having at least one inlet on the underside of the container and at least one outlet above the underside, whereby sand or silt under the container may be pumped away to cause the container to become buried in said or silt on the sea-bed, the pump means being operatively reversible to pump sand or silt underneath the container for raising the container.

2. A weapon system as claimed in claim 1 wherein the weapon is a torpedo.

3. A weapon system as claimed in claim 1 wherein the weapon is a ballistic missile.

4. A weapon system as claimed in claim 1 and having a target detection sensor within the container arranged to initiate launching of the weapon.

5. A weapon system as claimed in claim 1 wherein the container is watertight and pressure-tight.

6. A weapon system as claimed in claim 1 wherein at least the part of the container housing the weapon is watertight and pressure-tight.

7. An underwater weapon system comprising a self-propelled weapon with target homing means, and a container for said weapon, said container including pump means arranged for displacing sand or silt on the underside of the container whereby the container sinks into the sea bed, said container having control means for operating said pump means and further control means operative to open the container to permit release of the weapon and wherein means are provided to stop the pump means when the container is buried to a predetermined depth.

8. A weapon system as claimed in claim 7 wherein said control means for operating said pump means are arranged in response to a command signal to operate the pump means to raise the container to a position for weapon release.

9. A weapon system as claimed in claim 7 wherein means responsive to an external command signal are provided for activation of said further control means to open the continer for release of the weapon system.

10. A weapon system as claimed in claim 9 and having a receiver for receiving an acoustic or electromagnetic command signal.

11. A weapon system as claimed in claim 10 and having a retractable receiving sensor for receiving said command signal.

* * * * *